US007637301B2

(12) United States Patent
Forst Randle

(10) Patent No.: US 7,637,301 B2
(45) **Date of Patent: *Dec. 29, 2009**

(54) CELLULAR COVERINGS FOR ROLL-UP SHADES

(75) Inventor: Barbara Ann Forst Randle, Broomfield, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/141,555

(22) Filed: Jun. 18, 2008

(65) Prior Publication Data

US 2008/0264572 A1 Oct. 30, 2008

Related U.S. Application Data

(62) Division of application No. 11/012,583, filed on Dec. 14, 2004, now Pat. No. 7,513,292.

(60) Provisional application No. 60/531,360, filed on Dec. 19, 2003.

(51) Int. Cl.
*E06B 3/38* (2006.01)

(52) U.S. Cl. ..... 160/121.1; 160/84.05

(58) Field of Classification Search ..... 160/84.05, 160/121.1, 84.01; 156/197, 204, 226, 227, 156/218; 428/116, 118, 188
See application file for complete search history.

(56) References Cited

U.S. PATENT DOCUMENTS

| | | | | |
|---|---|---|---|---|
| 675,955 | A | 6/1901 | Kinnear | |
| 1,764,789 | A | 6/1930 | Heald | |
| 1,937,342 | A | 11/1933 | Higbie | |
| 2,140,049 | A | 12/1938 | Grauel | |
| 2,874,612 | A | 2/1959 | Luboshez | |
| 3,384,519 | A | 5/1968 | Froget | |
| 3,487,875 | A | 1/1970 | Shukat et al. | |
| 4,019,554 | A | 4/1977 | Rasmussen | |
| 4,039,019 | A | 8/1977 | Hopper | |
| 4,194,550 | A | 3/1980 | Hopper | |
| 4,677,013 | A | 6/1987 | Anderson | |
| 4,907,635 | A | 3/1990 | Bünger et al. | |
| 4,943,454 | A | 7/1990 | Neff | |
| 5,104,469 | A | 4/1992 | Colson | |
| 5,129,440 | A | 7/1992 | Colson | |
| 5,158,632 | A | 10/1992 | Colson et al. | |
| 5,503,210 | A | 4/1996 | Colson et al. | |
| 5,547,006 | A | 8/1996 | Auger | |
| 5,897,731 | A | 4/1999 | Colson et al. | |
| 7,191,816 | B2 * | 3/2007 | Colson et al. | 160/84.05 |
| 2006/0048659 | A1 | 3/2006 | Colson et al. | |

* cited by examiner

*Primary Examiner*—Blair M. Johnson
(74) *Attorney, Agent, or Firm*—Dorsey & Whitney LLP

(57) ABSTRACT

A cellular covering for a roll-up type shade assembly is described. According to one embodiment, the covering typically comprises a plurality of cells vertically disposed on a backing sheet. Each cell is configured to self-inflate when unrolled from a roller of the shade assembly.

9 Claims, 6 Drawing Sheets

CELLULAR COVERINGS FOR ROLL-UP SHADES

CROSS REFERENCE TO RELATED APPLICATION

This application is a divisional of U.S. application Ser. No. 11/012,583 filed Dec. 14, 2004, which application claims the benefit of U.S. provisional application No. 60/531,360 filed Dec. 19, 2003. The '583 application and the '360 application are incorporated by reference into the present application in their entirety.

BACKGROUND OF THE INVENTION

1. Field of the Invention

This invention relates generally to coverings for architectural openings, and more specifically to a roll-up shade having a cellular structure.

2. Description of the Relevant Art

Window shades composed of multiple layers of fabric arranged to create pockets of still air in their structure are commonly described as cellular shades. Cellular shades are desirable for their ability to not only help insulate an opening, such as a window, but also their pleasing aesthetic appearance.

Some cellular type shades have been of the accordion variety, wherein the cells are collapsed onto one another as a foot rail is raised to create a compact stack. This type of cellular shade typically requires lift cords that are threaded through the interior of the cells.

Conversely, typical roller shades do not utilize lift cords but rather, retraction is accomplished by simply rolling the shade material onto a roller. Fabrication of a roller shade is relatively inexpensive typically comprising cutting the shade material to size, attaching a roller and foot rail to the material and attaching the roller to a head rail. Roller shades are typically fabricated using flat covering materials that comprise one or more plies of fabric.

Several roll-up cellular shades have been devised that combine cellular coverings with the convenience and lower cost of the roll-up shade. One type of roll-up cellular covering is described by Thomas P. Hopper in U.S. Pat. Nos. 4,194,550, and 4,039,019. The roll-up shade coverings described in the Hopper patents comprise two essentially flat sheets that are separated by and held apart by a variety of devices that collapse as the coverings are rolled up. The Hopper shades are designed to maximize the insulating capabilities of the coverings, but because of the flat front and back sheets, the shades tend to lack the aesthetic appeal of more traditional cellular shades. U.S. Pat. No. 5,547,006 is an illustration of a shade which is arguably more aesthetically pleasing than the Hopper shades, resembling a conventional roman shade.

SUMMARY OF THE INVENTION

The present invention concerns various arrangements of cellular covering materials and roll-up type shade assemblies in which the materials are incorporated.

In some arrangements, a cellular shade covering comprises a back sheet of fabric and a plurality of generally parallel longitudinally-extending cells suspended from and spaced on the back sheet. Each cell includes a longitudinally extending strip of fabric. Each strip of fabric is formed to include a longitudinally-extending top edge and, a longitudinally-extending bottom edge, wherein the strip is attached to the back sheet at locations generally proximate both the top and bottom edge. The portion of the strip between the top and bottom edges extends away from the back sheet to form a cell.

In other arrangements, the cellular covering comprises a plurality of longitudinally-extending fabric strips. Each strip has longitudinally-extending top and bottom edges forming a longitudinally-extending cell with a top end and a bottom end, and wherein each strip is secured to the above adjacent cell proximate the top edge.

In still other arrangements, the cellular covering comprises a back sheet, and a plurality of generally parallel longitudinally-extending cells. Each cell of the plurality includes a longitudinally-extending strip of fabric having a longitudinally-extending top edge and a longitudinally-extending bottom edge. The longitudinally-extending strip of each cell is attached to the back sheet proximate the bottom edge at a first location. Further, the longitudinally-extending strip is also attached along its top edge to another longitudinally-extending strip of an above adjacent cell at a second location that is generally proximate the bottom edge of the above adjacent longitudinally extending strip.

In further arrangements, a cellular shade comprises a plurality of longitudinally-extending fabric cells. The cells are vertically spaced apart from each other and separated by an intervening vertically-extending fabric spacing section. Further, the cells are adapted to collapse when wound onto a roller of a roll-up type shade assembly and expand when the covering is unwound from the roller and extended.

Other aspects, features and details of the present invention can be more completely understood by reference to the following detailed description of a preferred embodiment, taken in conjunction with the drawings and from the appended claims.

DETAILED DESCRIPTION OF THE INVENTION

Various embodiments of cellular coverings for use with roll-up type shade assemblies are described. Each embodiment of the present invention includes a plurality of configurational elements for encouraging the cells of the coverings to expand ("inflate") when an associated covering is unrolled from a roller or extended to cover an architectural opening.

Throughout the description, the word "fabric" is used to describe the primary material comprising a cellular covering. It is to be appreciated that various types of suitable flexible sheets of materials can be used with the cellular coverings described herein. Suitable flexible sheet materials include fabrics, films, foils, flexible laminated sheets, and the like. Also, a sheet, as the term is used herein unless otherwise specifically stated, comprises either a single unitary piece or a plurality of strips or other shaped pieces that are adhesively or otherwise joined together to form a single piece that is thin in comparison to its length and breadth. Further, as described herein, adhesive seams are specified for joining the various pieces of fabric that form the cellular roll-up coverings together. While it is appreciated that the preferred embodiments utilize an adhesive material, other materials and/or manners of joining the various pieces of fabric together can be utilized. For instance, the adhesive seams could be replaced with sewn seams or could be ultrasonically welded. Alternatively, rivets or other types of mechanical fasteners could be used. Additionally, when a thermoplastic film or fabric material is utilized, the various strips and pieces could be fused together. Accordingly, as used herein, references to adhesives and adhesive seams are intended to cover all suitable manners of joining the associated pieces of fabric together.

Figure 1:
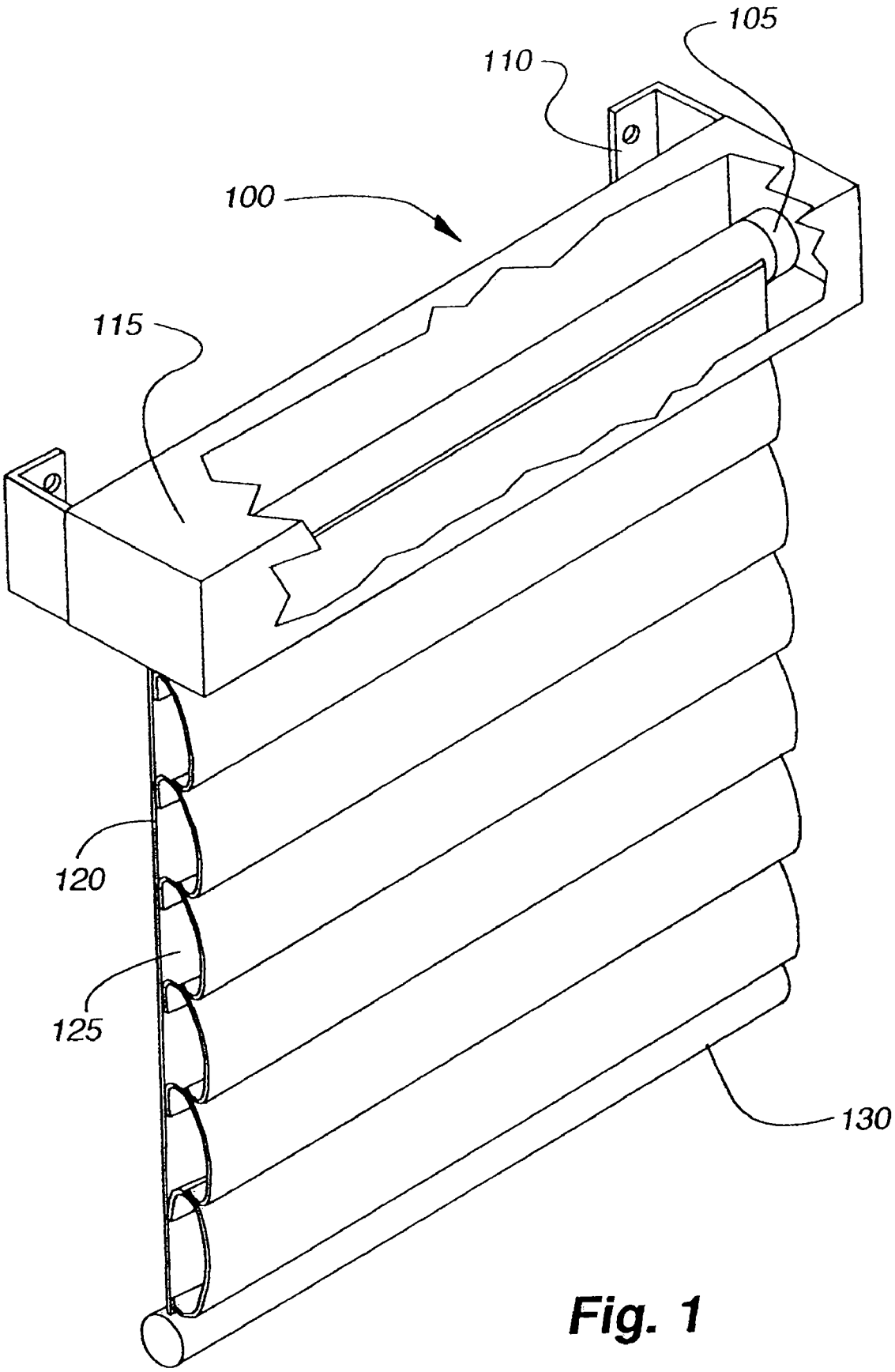
FIG. 1 is an isometric front view of a typical cellular roll-up shade according to one embodiment of the present invention.

FIG. 1 is an illustration of a typical cellular roll-up shade assembly according to the invention. The assembly 100 includes a roller 105 that is rotatably mounted at either end to mounting brackets 110. The mounting brackets are utilized to secure the assembly to a surface such as a wall or a casement that surrounds an architectural opening. The brackets 110 may also include features for attaching a housing 115 to the brackets. A typical housing is closed on the front side of the shade assembly and the sides thereof to hide the roller from view. A covering 120 is attached to the longitudinally-extending outside surface of the roller along the covering's generally horizontally-extending top. The covering includes one or more cells 125 of varying configurations as are described in detail below. A horizontally-extending bottom end of the covering that is opposite the top end may be attached to a foot rail 130 in selected embodiments. The foot rail 130 is generally weighted to help pull the covering downwardly as the covering is unwound from the roller. Additionally, the weight of the foot rail can help to cause the cells to "inflate" (open) as the covering 120 is deployed. Certain embodiments may not utilize a foot rail. Other embodiments may conceal a weight(s) or a dowel in a loop of covering material proximate the covering's bottom end.

The typical cellular roll-up shade assembly 100 also includes a retraction mechanism (not shown) adapted to retract the covering 120 by rolling the covering onto the roller 105. Retraction mechanisms for roll-up shades are well known in the art. One type of retraction mechanism comprises a spring that biases the roller relative to the mounting brackets 110 to rotate in either a clockwise or counterclockwise direction. The spring-type retraction mechanism also includes a locking device that counteracts the spring bias and holds the covering in an extended position. A user must release the locking mechanism to retract the shade. In a typical roll-up shade, the locking mechanism is released by pulling downwardly on the covering for a short distance. Some spring-type retraction mechanisms may also include a dampening device to brake and slow the rate of retraction of the covering. It is to be appreciated that other types of retraction devices or no retraction device can be utilized with the invention. For instance, a motorized retraction/extension device could be used with or without an associated remote control system to raise and lower the covering.

One of the primary considerations concerning the configuration of the cellular covering for use in roll-up shade assemblies is the tendency of the cells on the covering to open or inflate when the shade is unrolled. At least three configurational aspects of the cells of the present invention encourage inflation:

(1) the fabric "set" attributable at least partially to the curvature of the roller;

(2) the difference between the length of a front fabric portion between the top and bottom seams of a cell and the rear fabric portion between the same seams; and (3) the folds, bends or creases created in the fabric of the cells that when unrolled tend to cause the fabric of the cell to spring into a preferred set. Certain embodiments utilize additional configurational aspects to further promote inflation including: (1) configuring the cells to create a leverage effect; and (2) attaching the front portion of a top cell of a covering to one location on the roller and attaching a back portion of a cell at the top end of the covering to a second location on the roller circumferentially spaced from the first. Further, configurational aspects for amplifying the inflation of cells as described in U.S. Pat. No. 5,547,006, which is hereby incorporated by referencing its entirety, can be utilized with the coverings of the present invention.

Each cell 125 incorporated in the various covering embodiments of the present invention utilizes at least two folds within the fabric to help inflate and open the cell as it is unwound from the roller. When a covering is rolled up on the roller, the cell fabric at each fold typically folds over onto itself creating approximately a 180 degree bend. However, fabrics in general (and certain films, foils and laminates) are generally resistant to taking a sharp set and upon unrolling from the roller, the fabric unfolds at least partially, causing the associated cell to open.

Two types of folds are utilized in the embodiments described herein. The first type of fold is typically formed as a result of the configuration of the fabric comprising a cell that has not been given a permanent set by either (i) applying heat to a crease while the fabric is being restrained in the preferred position or (ii) running the fabric at the desired fold location through a creasing device. The second type of fold is that having a permanent set, wherein the fold is set to a specified degree of bend less than 180 degrees. With either type of fold, when the fold is unrolled from the roller, it will be encouraged to spring back to a degree of fold of less than a 180 degree bend, effectively pulling the associated portion of a cells fabric with it to inflate the cell.

Figure 2:
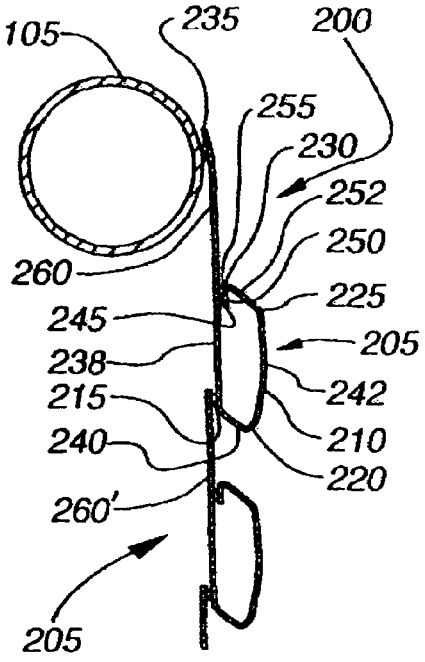
FIG. 2 is a fragmentary side view of a roll-up shade with a cellular covering according to a first embodiment of the invention.

A first embodiment of the present invention is illustrated in FIG. 2 and shows two cells 205 of a plurality of cells that comprise a cellular covering 200. Each cell 205 is box-shaped and formed from a strip of fabric 210 that includes a plurality of generally horizontally extending folds 215-230. Each strip comprising the covering 200 extends downwardly from a top edge 235 to a first fold 215 to form the back side 238 of the cell. From there, the strip extends forwardly to form the bottom side 240 of the cell. The strip forms a second fold 220 at the front edge of the bottom side. From the second fold, the strip extends generally upwardly to form the front side 242 of the cell. A third fold 225 is formed at the top edge of the front side. From the third fold, the strip extends rearwardly until it comes into contact with the back side 238 forming the top side 252 of the cell. At the junction with the back side, a fourth fold 230 is formed from which the strip then extends downwardly along the front surface of the back side for a short distance before terminating in a bottom edge 245. Between the bottom edge and the fourth fold, the terminal portion 250 of the strip is adhesively joined to the back side 238 at adhesive seams 255.

The back side 238 of each strip extends upwardly above the top side of the cell. Proximate the top edge of the topmost cell 205, the back side is attached with the roller 105. The top edge of each other cell of the plurality of cells including the lower cell 205 shown in FIG. 2 are joined to the back surface of the back side of the cell immediately adjacent and above the top edge by an adhesive seam 258. The resultant covering comprises a plurality of cells separated by spacing sections 260 and 260', typically comprising a single thickness of fabric, to provide an aesthetically pleasing product that can be easily retracted and extended from a roller of a roll-up shade assembly.

Referring to FIG. 2 and the first embodiment covering, when a cell 205 is rolled up onto the roller and a successive layer of the covering is wrapped over the cell, the top, bottom and front sides of the associated fabric strip 220 nest compactly against the back sheet with the strip folding to approximately 180 degree bends at folds 220 and 230. During extension or the unrolling of the covering from the roller, the tendency of the 180 degree bends at folds 220 and 230 to resiliently move back into a lower stress state having a lower bend angle, results in the opening or inflation of the cells.

Figure 3:
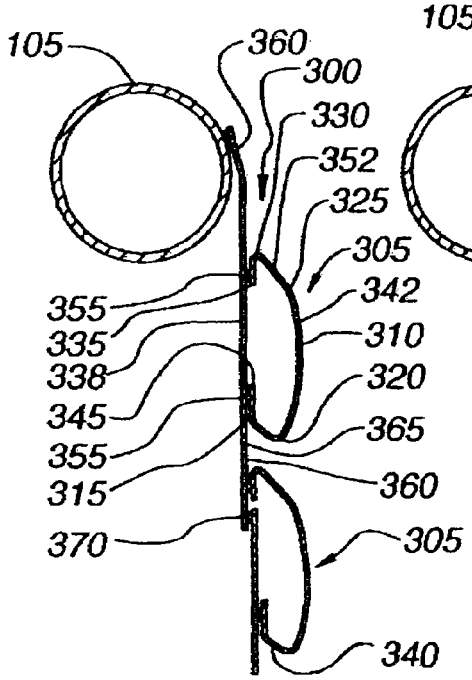
FIG. 3 is a fragmentary side view of a roll-up shade with a cellular covering according to a second embodiment of the invention.

A second embodiment of the covering in accordance with the present invention is shown in FIG. 3. In this embodiment, the back sides 338 of the cells 305 and the spacing sections 360 between adjacent cells are comprised of a fabric sheet 365 separate from the top, bottom and front sides of the cells. By utilizing a separate fabric sheet for the back sides 338 and spacing sections 360, different fabric colors can be utilized resulting in a covering that when viewed from the front alternates between cells 305 of one color and spacing sections 360 of another color resulting in a covering 300 with an aesthetically pleasing striped appearance.

Further, as specifically illustrated in FIG. 3, the fabric sheet 365 comprising the back side 338 and spacing sections 360 can also be comprised of a plurality of fabric strips adhesively joined along adhesive seams 370. It is appreciated that these strips could be the same type of material or differing types of material of differing colors if desired. Additionally, since each cell is made of a different strip of fabric, each cell could be of a different color.

The construction of a typical second embodiment cell will now be described in reference to FIG. 3. A generally horizontally-extending first fold 330 is formed a short distance from the top edge 335 of the fabric strip 310 comprising the top, front and bottom sides of the cell. The section of fabric between the top edge 335 and the first fold 330 is adhesively bonded to the front surface of the fabric sheet 365 comprising the back side 338 of the cell along a generally horizontally-extending adhesive seam 355. From the first fold, the fabric strip 310 extends outwardly to form the top side 352 of the cell. The top side of the cell terminates at a second fold 325 and the fabric strip extends downwardly to form the generally vertical front side 342 of the cell. The front side terminates at a third fold 320 and the fabric strip continues inwardly to a fourth fold 315 to form the bottom side 340 of the cell. From the fourth fold, the strip 310 extends upwardly for a short distance and ends at a bottom edge 345 of the fabric strip. Between the bottom edge and the fourth fold, the cell is adhesively joined to the back side fabric sheet 365 by a generally horizontally-extending adhesive seam 355.

In a manner similar to the first embodiment, the cells of the second embodiment fold flat against the back side fabric sheet forming 180 degree bends at folds one and three. During the unrolling or extension of the covering from the roller, the cells inflate due to the unfolding and resiliency at folds one and three.

Figure 4:
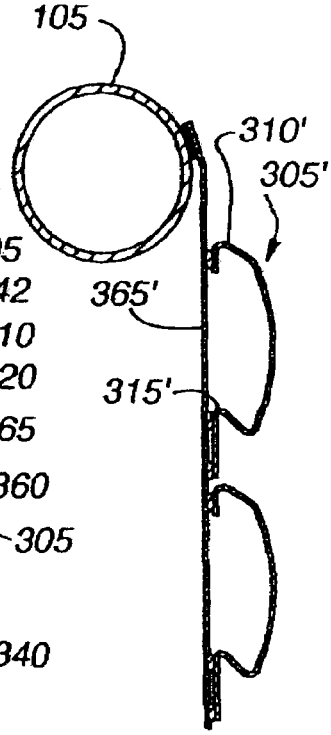
FIG. 4 is a fragmentary side view of a roll-up shade with a cellular covering according to a third embodiment of the invention.

Referring to FIG. 4, a third embodiment is very similar to the second embodiment except the fabric strip 310' forming the cell 305' extends downwardly instead of upwardly from the equivalent of the fourth fold 315'. Accordingly, when the cell is collapsed onto the roller three 180 degree bends are created providing additional cell expansion force due to the third 180 degree bend at the fourth fold 315'. As shown in the third embodiment, the shade comprises a single fabric back sheet 365', but as with the second embodiment (FIG. 3), the back sheet can be fabricated from more than a single strip.

The inflation of the first three embodiments are highly influenced by the type of fabric utilized to construct the cells. Stiffer fabrics that are also more resistant to creasing or taking a permanent set at ambient use conditions tend to create fuller and better defined cells. The spacing between the cells lacks the insulating value of the cells, but the visual emphasis of the cells' shape is accentuated by the spacing which provides a unique and pleasing aesthetic appearance.

Embodiments four, five and six provide for cells that extend continuously over the surface of the covering providing for good insulating characteristics when compared to roll-up coverings without cells or with spaced cells. Further, the expanded cells provide an aesthetically superior look when compared to non-cellular roll-up shade coverings.

Figure 5:
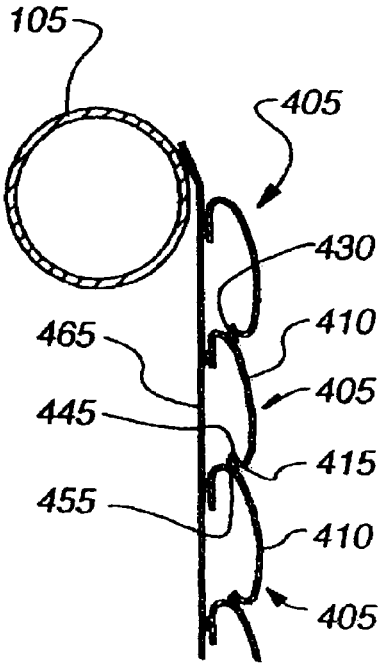
FIG. 5 is a fragmentary side view of a roll-up shade with a cellular covering according to a fourth embodiment of the invention.

Referring to FIG. 5, the fourth embodiment cellular shade can be viewed as a variation on the second embodiment where the portion of the fabric strip 410 of a cell 405 that extends upwardly before terminating in a bottom edge 445 is secured typically along an adhesive seam 455 to an adjacent lower cell 405 instead of the back side fabric sheet 465. By using this type of attachment, the inflation of each cell is amplified and further encouraged into an open position not just by the folds in the cell 405 itself but by the inflation or opening of the adjacent lower cell 405. Cells of this type of configuration can be made into a wide variety of configurations by varying the size of the fabric strips that comprise the cells. For instance, the thickness of the cell when inflated is largely a function of the distance between the location of the adhesive seam 455 on the front or top side of the cell and the cell's location of attachment to the back sheet 465 proximate its first fold 430. Further, the degree of longitudinal curvature along the front side 442 of each cell is affected by both the stiffness of the fabric and the length from the location of attachment of the above adjacent cell and the attachment location proximate with the below adjacent cell. As illustrated in FIG. 5, only two distinct folds 430 and 415 are shown. It is to be appreciated, however, that cells 405 having additionally more distinct or set-creased fold lines are contemplated.

FIG. 5 is shown with the cells 405 of the covering facing outwardly as they are rolled onto the roller 105. In a variation, the cells could face inwardly towards the roller. During the unrolling of this variation, the inflation contribution attributable to the fabric "set" from the curvature of the roller would be lost.

Figure 6:
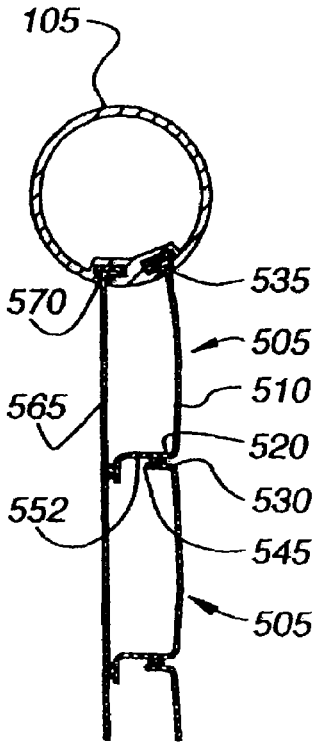
FIG. 6 is a fragmentary side view of a roll-up shade with a cellular covering according to a fifth embodiment of the invention.

Referring to FIG. 6, a fifth embodiment of the invention is presented. The fifth embodiment is generally similar to the fourth embodiment except the top edges 535 and 570 of the topmost cell's fabric strip 510 and the back sheet 565 are each mounted to the roller 105 along circumferentially-spaced longitudinal lines of attachment. This spaced configuration causes the topmost cell to pull the front faces of the lower cells open when the covering is fully extended.

Additionally as illustrated in FIG. 6, the configuration of the fabric strips 510 that help form each cell differs from the fourth embodiment. The top edge 545 of each fabric strip 510 (except the strip for the topmost cell) is attached to the above adjacent cell 505 at a location proximate both the first fold 530 of the cell and the third fold 520 of the above adjacent cell 505. The top side 552 of each cell also comprises the bottom side of the above adjacent cell. It is to be appreciated that one variation of the fifth embodiment can utilize a fabric strip construction that is essentially identical to that of the fourth embodiment.

Figure 7:
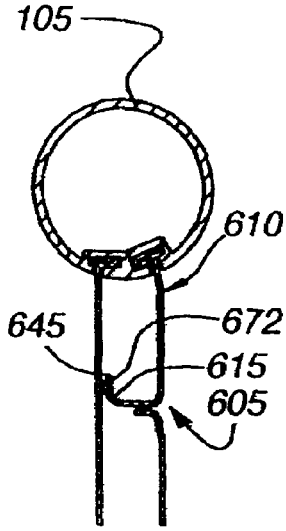
FIG. 7 is a fragmentary side view of a roll-up shade with a cellular covering according to a sixth embodiment of the invention.

Referring to FIG. 7, the sixth embodiment is illustrated. The sixth embodiment differs from the fifth embodiment only in that the section 672 of the fabric strip 610 between the bottom most fold 615 and the bottom edge 645 of the fabric strip 610 extends upwardly instead of downwardly. Accordingly, when the covering is rolled up, the fabric strip at the location of the bottom most fold 615 lies flat. This cell structure results in a smaller roll size when compared to the fifth embodiment, but also typically results in thinner cells 605 depending on the characteristics of the fabric utilized.

Figure 8:
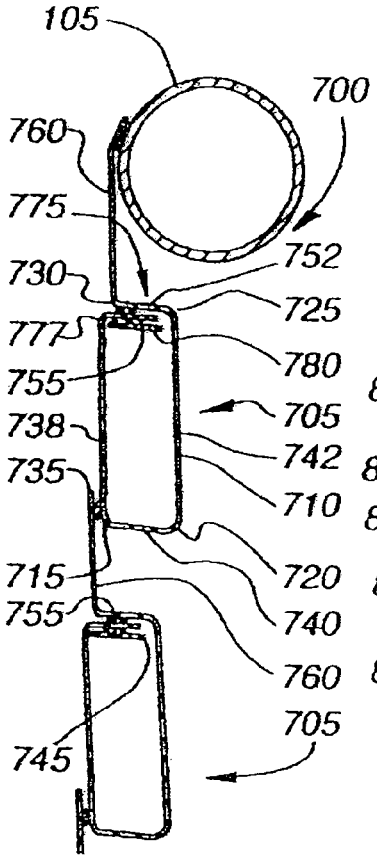
FIG. 8 is a fragmentary side view of a roll-up shade with a cellular covering according to a seventh embodiment of the invention.

Embodiments seven through fifteen are cellular coverings wherein the cells face the roller 105 upon retraction. Additionally, these coverings include vertical spacing sections between each cell similar to embodiments one through three. Unlike the preceding embodiments, however, these embodiments utilize a lever arm effect to pull the cells open upon being unrolled from the roller. Referring generally to FIG. 8 and the seventh embodiment, the weight of the cells and/or foot rail below a cell 705 being unrolled from a roller 105 create a tension force in the back side 738 of the cell which pulls down on a lever arm 775 formed at the top side 752 of the cell. The lever arm pivots about an adhesive seam 755 with an upwardly extending spacing section 760, causing the front edge of the lever and the front side 742 of the cell to be opened or inflated.

Still referring to FIG. 8, each cell is typically comprised of a strip of fabric material 710. The top edge 735 of the fabric strip is adhesively secured to the bottom corner of the above adjacent cell along the backside thereof proximate the fourth bend 715 of the above adjacent cell (except for the topmost cell in which the fabric strip is secured to the roller). The strip 710 extends downwardly from its top edge forming a spacer section 760. The spacer section terminates at a first fold 730 and the fabric strip continues extending forwardly to a second fold 725 forming a portion of the cell's top side 752 as well as the lever arm 775. From the second fold, the strip extends generally vertically downwardly to form the front side 742 of the cell 705. The front side of the cell terminates at the third fold 720 wherein the fabric strip extends rearwardly towards a fourth fold 715 to form the bottom side 740 of the cell. From the fourth fold, the fabric strip extends upwardly to a fifth fold 777. From the fifth fold, the fabric strip extends forwardly passing underneath the first fold 730 and a portion of the strip between the first and second folds before terminating at the bottom edge 745 of the strip 710. The portions of the fabric strip between the first fold and the second fold and between the fifth fold and the bottom edge collectively form the top side 752 of the cell, which is, therefore, laminated. These two portions are attached to each other along an adhesive seam 755 proximate the first fold, which is located laterally between the fifth and second folds. The adhesive seam forms a pivot point for the top side lever arm 775. In order to transfer a portion of the tension force from the back side 738 to the front side 742, the lever arm must be of sufficient stiffness to carry the load. Accordingly, a plastic strip 780, such as a strip of polyester sheet, may be bonded to the bottom of the top side. In practice, the plastic strip can be relatively thin such as half the thickness of the fabric strip but still add sufficient stiffness to the lever arm. Additionally, depending on the type of fabric utilized, the doubling up of the fabric mat may create a top side of sufficient stiffness to act as the lever arm without a plastic strip.

The ratio of the length of the lever arm 775 on either side of the adhesive seam 755 is an important design variable. The shorter the lever portion to the left of the adhesive seam 755 is relative to the portion to the right of the adhesive seam 755, the less force there will be available to pull the cell 705 open. However, the cells of the seventh embodiment like the cells of the other embodiments are also encouraged to open or inflate due to the effect of 180 degree folds. In this embodiment the resistance to bending of the third and fifth folds 720 and 777 also helps to open the cells during unrolling. Accordingly, because of the combined opening forces, a left lever arm as short as 0.625" and possibly as short as 0.30" can still be sufficient to provide the necessary force to open a cell. To facilitate easy retraction and roll-up of the seventh embodiment covering the angle between each lever arm 775 and the front side 742 of each cell suspended from the lever arm at the second fold 725 should be at least 90 degrees when the cell is fully inflated.

Figure 9:
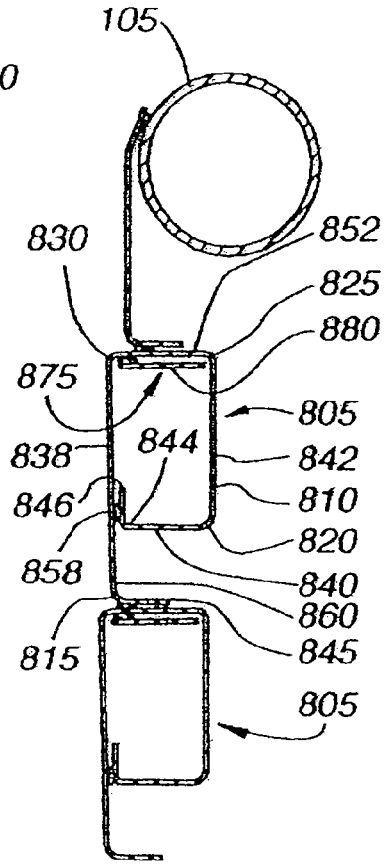
FIG. 9 is a fragmentary side view of a roll-up shade with a cellular covering according to an eighth embodiment of the invention.

Referring to FIG. 9, an eighth embodiment is illustrated. The cells 805 of the eighth embodiment are constructed differently from those of the seventh embodiment but the mechanical forces acting on the structure to cause the cells to inflate are similar to those of the seventh embodiment. Of particular note with the eighth embodiment is that the surface of the fabric strip facing forwardly in the spacing section 860 is different from the surface of the fabric strip facing forwardly on the front side 842 of the cell. Accordingly, if a fabric strip 810 is used to make the covering that has surfaces of different colors, the resulting shade will have a horizontal striped look with the cells and the spacing sections being of different colors.

The strip of fabric that comprises a cell 805 in the eighth embodiment includes a bottom edge 845 and extends generally horizontally from the edge to a first fold 815. This horizontal portion of the fabric strip is coextensive with and forms part of the top side 852 of the below adjacent cell 805. From the first fold, the strip extends upwardly to form a spacing section 860 and the back side 838 of the cell. The back side terminates at the second fold 830 where the fabric strip extends generally horizontally forwardly to a third fold 825 to form the top side of the cell. From the third fold, the fabric strip extends generally vertically downwardly to a fourth fold 820 forming the front side 842 of the cell. From the fourth fold, the fabric strip extends horizontally rearwardly to a fifth fold 844, forming the bottom side 840 of the cell. From the fifth fold, the fabric strip extends upwardly a short distance to a top edge 846 overlapping the back side 838. The fabric strip proximate the fifth fold 844 is adhesively secured to the back side by an adhesive seam 858. Like the seventh embodiment, a strip of plastic or metallic material 880 may be adhesively bonded to the bottom of the top side to create a lever arm 875 of satisfactory stiffness.

Figure 10:
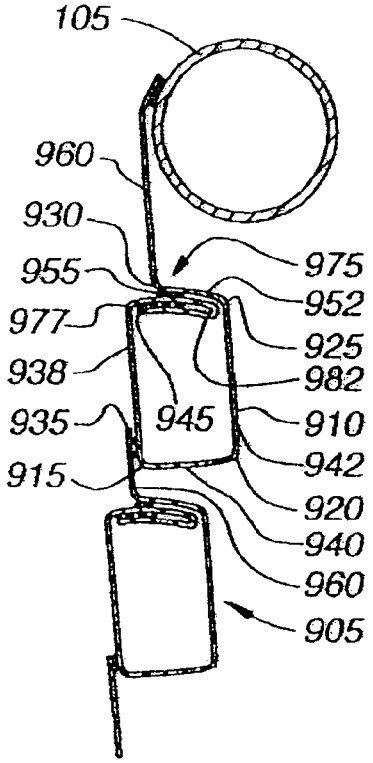
FIG. 10 is a fragmentary side view of a roll-up shade with a cellular covering according to a ninth embodiment of the invention.

Referring to FIG. 10, the ninth embodiment is substantially similar to the seventh embodiment except the fabric strip of each cell is folded over onto itself at a sixth fold 982 to form a doubled up top side 952. The doubled up top side adds additional stiffness to the top side lever arm 975 and depending on the type of fabric utilized, a plastic strip may become unnecessary. The variations of the ninth embodiment may only be suitable for a roll-up shade with a covering of a limited length since lever arms comprised of fabric alone in the topmost cells of the covering may not be able to withstand the weight of a longer covering hanging therefrom.

Figure 11:
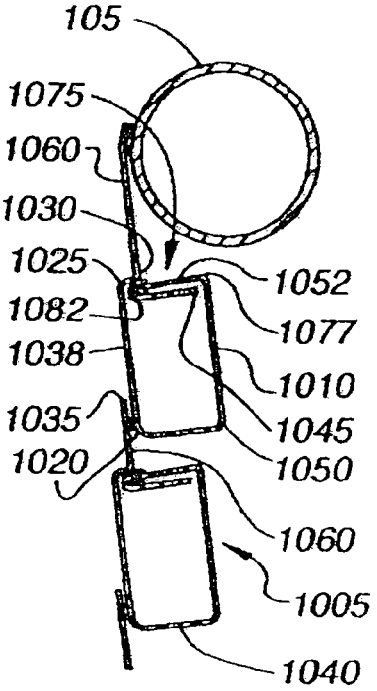
FIG. 11 is a fragmentary side view of a roll-up shade with a cellular covering according to a tenth embodiment of the invention.

FIG. 11 illustrates the tenth embodiment which is another variation on the seventh embodiment. The cells of the tenth embodiment are constructed differently from those of the seventh embodiment but the mechanical forces acting on the structure to cause the cells to inflate are similar to those of the seventh embodiment.

The strip of fabric 1010 that comprises a cell 1005 in the ninth embodiment includes a top edge 1035 where the fabric strip is adhesively secured to the back side 1038 of the above adjacent cell. From the top edge the fabric strip extends generally vertically downwardly to a first fold 1030 forming a spacing section 1060. From the first fold the strip extends rearwardly and generally horizontally to a second fold 1025 forming a portion of the cell's top side 1052 as well as the left portion of the top side lever arm 1075. From the second fold, the strip extends generally vertically downwardly to form the back side 1038 of the cell. The back side of the cell terminates at the third fold 1020 wherein the fabric strip extends forwardly towards a fourth fold 1050 to form the bottom side 1040 of the cell. From the fourth fold, the fabric strip extends upwardly to a fifth fold 1077 forming the front side of the cell. From the fifth fold, the fabric strip extends rearwardly passing below the first fold and the portion of the strip between the first and second folds before being folded back upon itself at a sixth fold 1082 and adhesively secured to itself. The fabric strip terminates at a bottom edge 1045 proximate the fifth fold.

Figure 12:
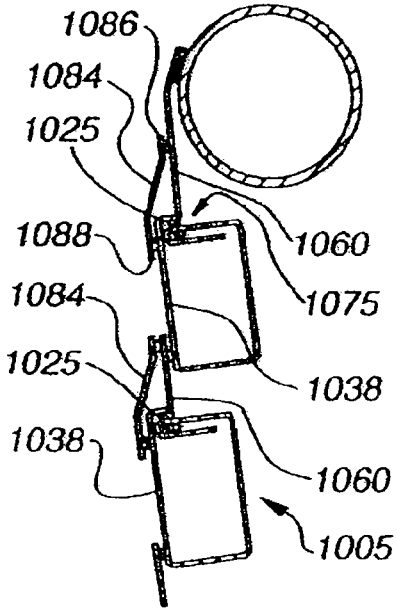
FIG. 12 is a fragmentary side view of a roll-up shade with a cellular covering according to an eleventh embodiment of the invention.

FIG. 12 illustrates the eleventh embodiment which is another variation on the tenth embodiment. The cells on the eleventh embodiment are similarly constructed from fabric strips as the cells of the tenth embodiment. The eleventh embodiment, however, includes additional fabric strips 1084, each additional strip extending from a top end 1086 secured to an intermediate vertical location on the back of a spacing section 1060 to a bottom end 1088 secured to a location on the back side 1038 of a cell proximate the second fold 1025 of the cell. These additional strips act to limit the amount the lever arms 1075 may be pivoted. It is appreciated that the additional pivot limiting strips 1084 can be utilized with any of the embodiments utilizing a lever arm to assist in cell inflation.

Figure 13:
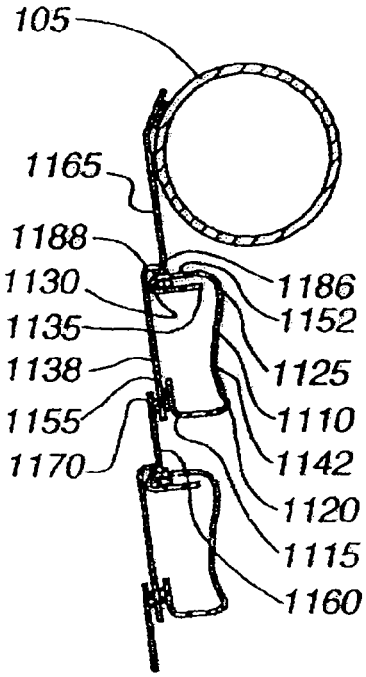
FIG. 13 is a fragmentary side view of a roll-up shade with a cellular covering according to a twelfth embodiment of the invention.

FIG. 13 illustrates the twelfth embodiment which is another variation on the tenth embodiment. In this embodiment, the back sides 1138 of the cells and the spacing sections 1160 are formed from a separate piece of material from the other sides of the cells in a manner similar to that described above concerning the second embodiment. The rear strip or strips of fabric 1165 comprising the back side hang generally vertically from the roller 105 and may include two bends 1186 and 1188 proximate their connection to the top side 1152 of a cell; a first back strip bend 1186 at the location of the joint with the top side of the cell, and a second back strip bend 1188 to the rear of the first back strip bend. As shown in FIG. 13, the cellular shade comprises a plurality of rear strips that are joined together by adhesive seams 1170, although in variations the back sides and spacing sections can comprise a single rear strip.

A separate cell fabric strip 1110 is utilized to form the top, front and bottom sides of each cell of the twelfth embodiment. Each cell strip extends rearwardly from a top edge 1135 to a first bend 1130 where the strip is folded over onto itself and extends forwardly to a second bend 1125, thereby forming a doubled top side of the associated cell. From the second bend 1125, the cell strip extends downwardly to a third bend 1120 to form the front side 1142. As illustrated depending on the type of fabric utilized with the cell strip, an impression may be left on the front side of the cell from the curvature of the roller, thereby adding an additional aesthetic quality to the covering. From the third bend 1120 the cell strip extends rearwardly to a fourth bend 1115 whereas the cell strip extends upwardly a short distance adjacent the corresponding rear strip 1165. The cell strip is secured to the rear strip through an adhesive seam 1155 proximate the fourth bend.

Figure 14:
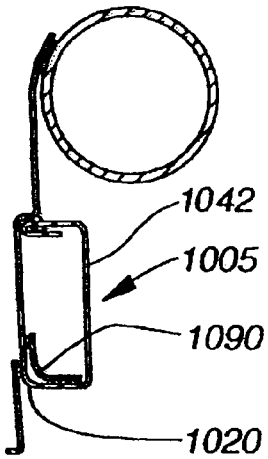
FIG. 14 is a fragmentary side view of a roll-up shade with a cellular covering according to a thirteenth embodiment of the invention.

FIG. 14 illustrates a thirteenth embodiment. The thirteenth embodiment is a variation on the tenth embodiment incorporating a relatively stiff strip of plastic 1090 that is secured to the inside of the cell by an adhesive and spans the fourth bend 1020 thereof. The resiliency of the strip when flexed, while the associated covering is in its deployed position, acts to pull the front side 1042 of the cell 1005 taut and flat. This configuration has been found to be most useful with relatively large cells wherein the curvature set of the roller can be more pronounced.

Concerning any of the embodiments described herein, variations in the construction of the shapes described can be accomplished by altering dimensions and through the use of fabrics with greater or lesser resiliency stiffness and resistance to creasing. Additional seams can also be added to insert new fabric strips of a different material at any point in the coverings. In some cases such as the first embodiment shown in FIG. 1, the bottom edge of the covering may be attached to the roller, creating a minor variation in the shape of the covering's cells.

Figure 15:
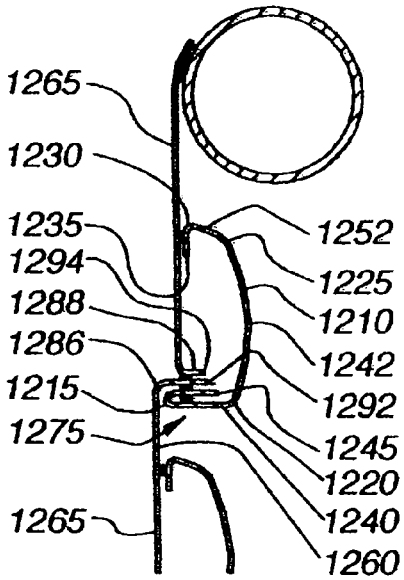
FIG. 15 is a fragmentary side view of a roll-up shade with a cellular covering according to a fourteenth embodiment of the invention.
Figure 16:
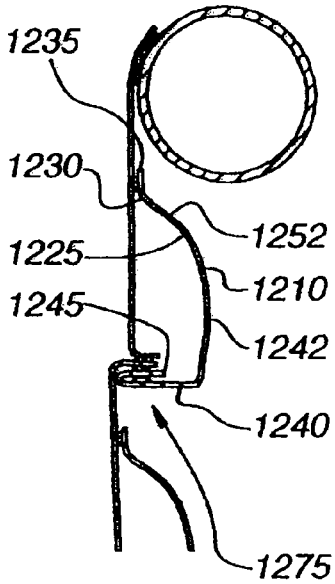
FIG. 16 is a fragmentary side view of a roll-up shade with a cellular covering according to a fifteenth embodiment of the invention.

While attaching the bottom edges of the coverings to the rollers instead of the top edges will not work for the lever arm embodiments seven through thirteen (FIGS. 8-12), the lever arm principles can be reversed as indicated in Embodiments fourteen and fifteen as shown in FIGS. 15 and 16. In these embodiments, the cells are deflected upwardly from the bottom side 1240 of the cells as a result of the tension on the cells. While the structure of the cells is substantially reversed, the overall appearance of the cells is not significantly different from those using a top side lever.

The fourteenth and fifteenth embodiments differ only in the manner in which the fabric cell strips 1210 are attached to the fabric rear strips proximate their top edge 1235. In the fourteenth embodiment (FIG. 15), the strip is folded downwardly proximate its attachment to the rear strip at its top edge. In the fifteenth embodiment (FIG. 16), the strip is folded upwardly proximate its attachment to the rear strip at its top edge. Only the fourteenth embodiment is described in detail in the following paragraph since the fifteenth embodiment is substantially similar save for the aforementioned difference.

Referring to FIG. 15, a fabric rear strip 1265 extends rearwardly from its front edge 1292 until a first rear strip fold 1286 where it extends downwardly at 1260 from the bottom side 1240 of the above adjacent cell until a second rear strip fold 1288. The rearwardly extending portion of the rear strip forms part of the bottom side 1240 and lever arm 1275 of the preceding cell. From the second fold, the strip extends forwardly for a short distance until terminating at its bottom edge 1294. The forwardly extending portion forms both part of the bottom side and the lever arm of the corresponding cell. In the case of the topmost rear strip it is secured directly to the roller 105, typically by an adhesive strip.

A fabric cell strip 1210 forms the top, front and bottom sides of each cell. The cell strip extends upwardly for a short distance from its top end 1235 to a first bend 1230. Along this distance the cell strip is adhesively secured to the rear strip. From the first bend, the strip extends generally forwardly to a second bend 1225 to form the top side 1252 of the cell. As can be seen in FIGS. 14 and 15, the second bend may be gradual rather than sharp or creased. From the second bend, the cell strip extends generally downwardly to a third bend 1220 to form the front side 1242 of the cell. From the third bend, the cell strip extends rearwardly to a fourth bend 1215 forming the bottom surface 1240 of the bottom side. From the fourth bend, the cell fabric is folded back onto itself and extends forwardly until terminating at a bottom edge 1245 of the cell strip. The cell strip is secured to itself where it is folded back onto itself.

As discussed above, concerning other embodiments, the doubled-up cell strip in conjunction with the folded over portions of the rear strip cause the bottom side to be significantly stiffer than the other sides of the cell thereby effectively forming a lever arm 1275. The rear strip 1265 that forms the back side of the cell is connected to the lever arm at an intermediate location where the lever arm can pivot about the connection location. The front edge of the lever arm is connected to the front side of the cell at the third bend 1220, and the other edge of the lever arm is connected to the depending cells by the associated rear strip. In operation, the weight of the depending cells pulls the lever arm downwardly to the left of the pivot location causing the portion of the lever arm in front of the pivot location to rise upwardly inflating the cell.

A sixteenth embodiment of a covering in accordance with the present invention is illustrated in FIGS. 20-25. In this embodiment, a plurality of cells 1305 are interconnected with each cell and an adjacent spacing section being formed from a single strip 1310 of material. The strip of material as viewed in a substantially deflated cellular configuration in FIG. 22 has a first end 1315 adjacent to the bottom wall 1317 of the cell with the strip extending straight upwardly to a first fold 1320 so as to define a rear wall 1322 of the cell. The first fold is a sharp fold approaching 180°. At the first fold, the strip is returned downwardly along an arcuate path to a fold or curve 1324 so as to define the front wall 1326 of the cell between the first fold and the curve 1324. At the curve 1324, the strip extends rearwardly, passes through a second curve 1328 so as to extend upwardly and is connected at 1325 with adhesive or the like to the first end 1315 at a location spaced from a second end 1330 of the strip. The strip, between its second end 1330 and the connection at 1325 defines a spacing section 1332 which is folded downwardly at a fold 1334. The second end 1330 has a bead of adhesive so that it can be connected to the rear wall of the next adjacent underlying cell to secure the next adjacent underlying cell to the front surface of the spacing section between the adjacent cells.

As will be appreciated, a plurality of elongated cells formed and interconnected in this manner form the overall covering and a weighted rail (not shown) may be provided at the bottom to encourage full extension of the covering. The uppermost cell in the covering is connected to a roller 1336 (FIG. 25) on the rear side of the roller with a connector strip 1338 that is adhesively secured to the rear surface of the rear wall of the cell adjacent to its top end. The connector strip is also secured to the roller in any suitable manner such as with adhesive 1340.

Figure 20:
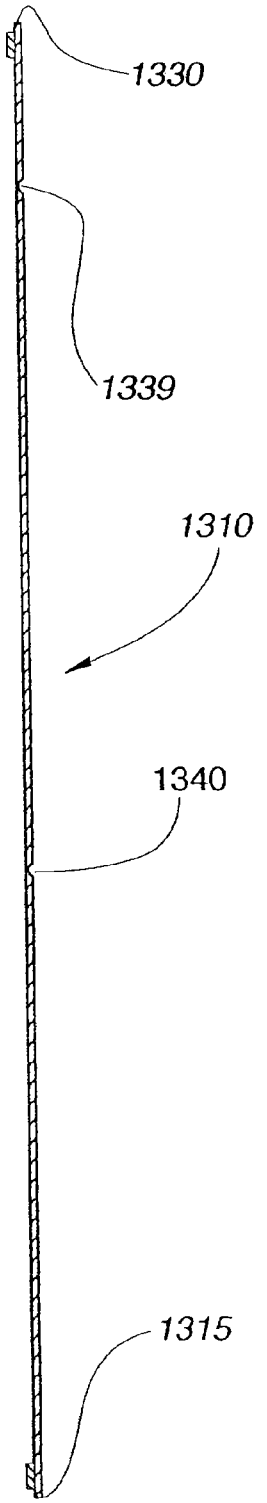
FIG. 20 is a transverse section taken through a strip of material used in making a cell for a sixteenth embodiment of the present invention.
Figure 21:
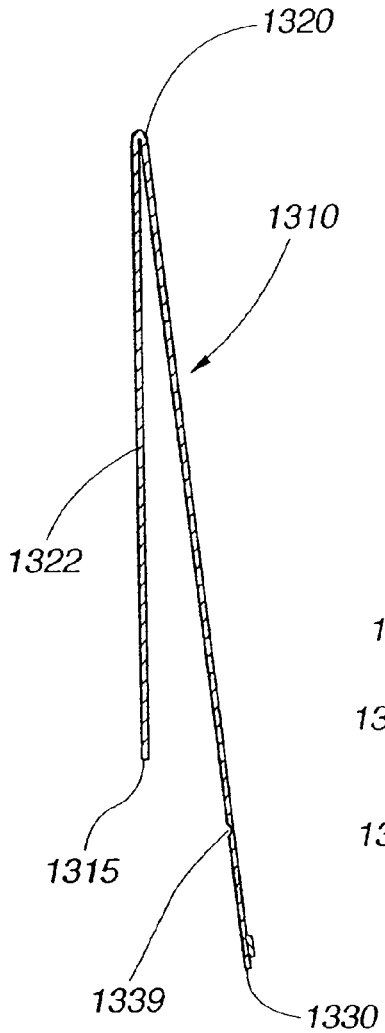
FIG. 21 is a transverse section similar to FIG. 20 with the strip having been initially folded.
Figure 22:
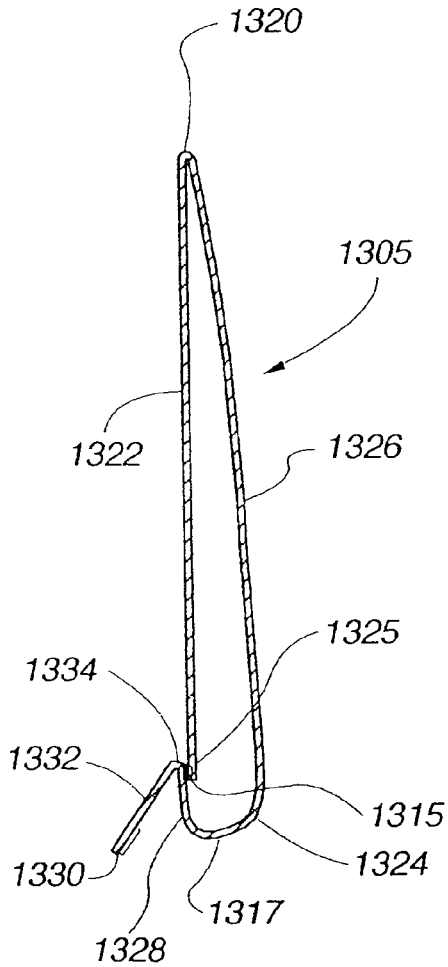
FIG. 22 is a transverse section similar to FIGS. 20 and 21 with the strip finally folded into a cellular configuration.

With reference to FIG. 20, the strip 1310 of material having the desired stiffness and resiliency is illustrated in transverse cross-section, it being appreciated that the strip is of a length corresponding to the width or breadth of the covering to be formed from a plurality of the cellular formed and interconnected strips. The rear face of the strip has an elongated bead of adhesive on its rear surface adjacent to the upper or second end 1330 and a bead of adhesive on its rear surface adjacent to the lower or first end 1315 thereof. A pair of creases are conventionally formed in the strip, one 1339 in the rear surface just below the upper end 1330 of the strip and the other 1340 just below a midpoint of the height of the strip on its front surface. In FIG. 21, the strip is seen to be folded along the crease 1340 so as to define a straight vertical segment that becomes the rear wall 1322 of a cell formed from the strip and a straight front segment which is ultimately curved and becomes the front wall 1326 and bottom wall 1317 of the cell as well as the spacing section 1332. The strip is next folded along the crease 1339 adjacent to the second end 1330 of the strip as shown in FIG. 22 and the front straight segment of the strip as shown in FIG. 21 is curved along the bottom wall 1317 and is attached at 1325 to the end 1315 by the adhesive strip that was provided along the first end 1315 of the strip. As can be seen in FIG. 22, the strip then assumes the form of a cell 1305 having a sharp bend 1320 at the top that approaches 180° and a broader bottom wall 1317 that is curved with the spacing section 1332 being a straight depending segment that becomes almost coplanar with the rear wall 1322 of the cell when interconnected with underlying cells.

Figure 23:
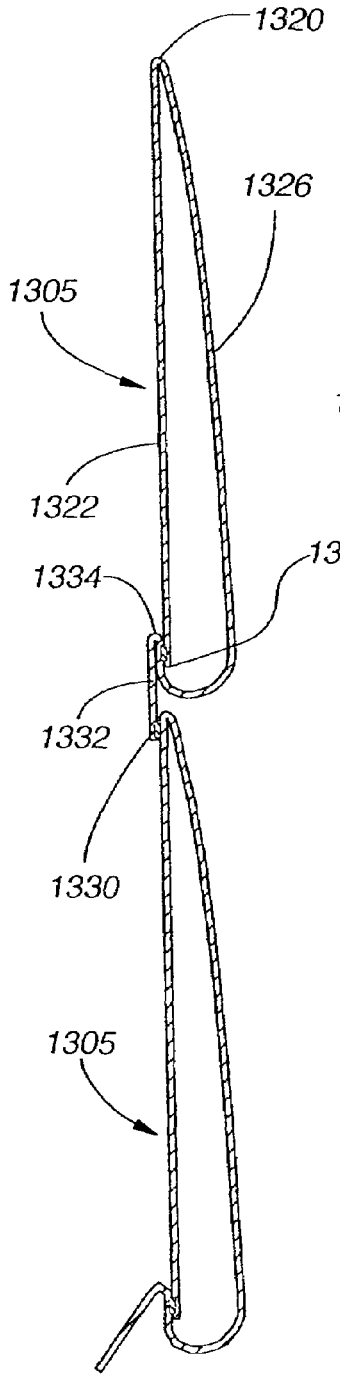
FIG. 23 is a transverse section of two interconnected cells of the type shown in FIG. 22 in a partially inflated condition.
Figure 24:
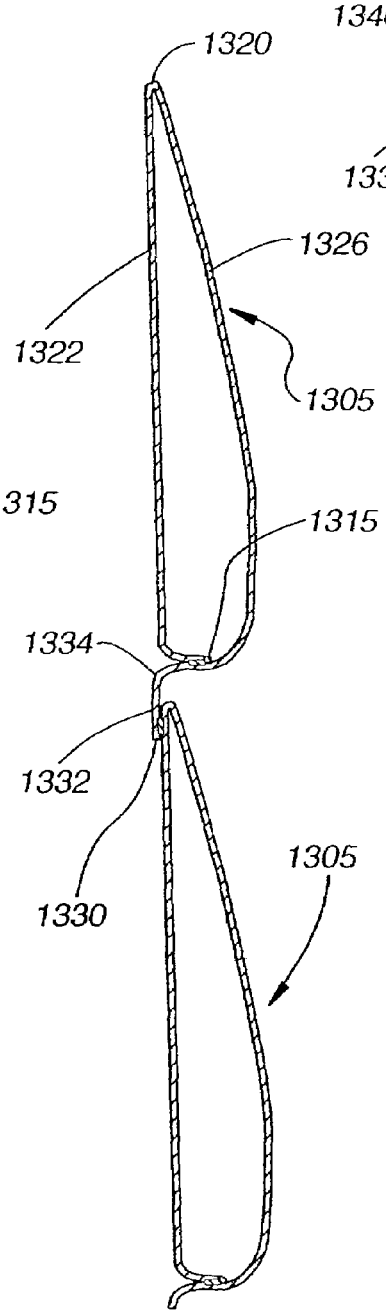
FIG. 24 is a transverse section similar to FIG. 23 showing the cells fully inflated.
Figure 25:
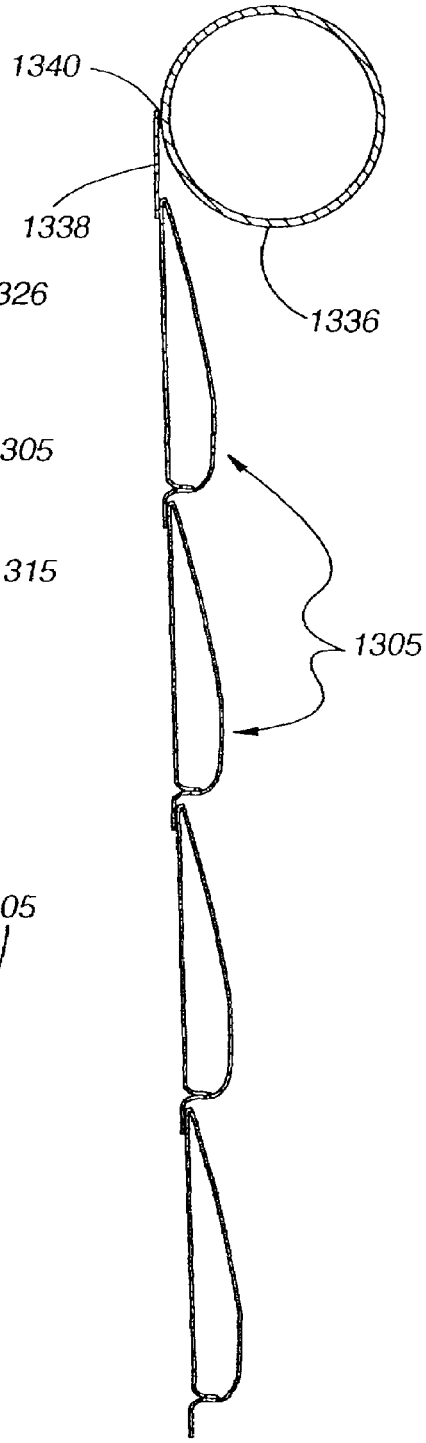
FIG. 25 is a transverse section similar to FIG. 24 with a plurality of interconnected cells suspended from a take-up roller.

FIG. 23 shows a pair of interconnected cells 1305 before weight has been applied to the cells causing them to fully expand or inflate as seen in FIG. 24. Before the weight is applied, the connection of the first end 1315 of the strip to the location 1325 adjacent to the second end 1330 is shown positioned along the rear of the cell. However, when weight is applied to the bottom of the covering made from the interconnected cells, this location 1325 is leveraged forwardly into the position shown in FIG. 24 which causes the cell to expand forwardly or inflate. It will therefore be appreciated that the degree of expansion can be regulated by the amount of weight carried at the bottom of the covering.

Several embodiments may be combined to create a covering that has cells on both its front and back sides. For instance, the cells of the fourth embodiment could be combined with the cells of the seventh embodiment. The spacing between the cells can be uniform or varied according to a desired pattern. Additionally, the sizes of the cells can be varied over a single covering.

Figure 17:
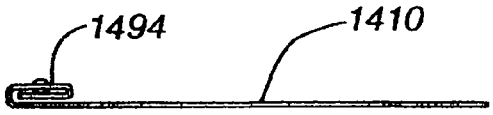
FIG. 17 is an end view of a strip of fabric with a hem at one end for use in forming a cell of a cellular covering.
Figure 18:
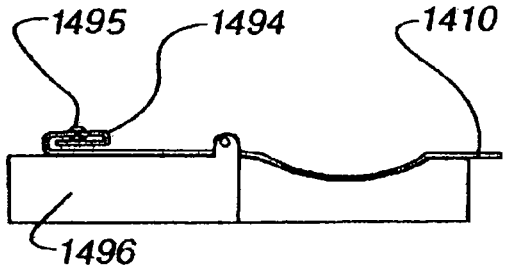
FIG. 18 is a side view illustrating a strip of fabric positioned in a hinged platen for use in forming a cell of a cellular covering.
Figure 19:
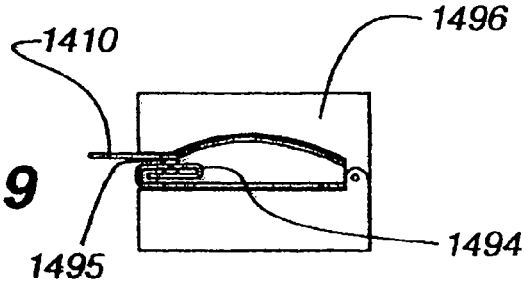
FIG. 19 is a side view showing the hinged platen of FIG. 17 closed with the strip of fabric therein to form the cell.

FIGS. 17-19 illustrate various operations that may be utilized in manufacturing cellular coverings in accordance with the invention. While variations of the manufacturing apparatus will be required to produce the various cell shapes taught herein, each cell type is characterized by an aggregate front side, top side and bottom side that is longer than its back side, and each cell-type is adhesively bonded along both edges of the fabric strip that forms each cell. It is appreciated that some of the cell-types require additional adhesive seams, and as in several of the embodiments additional pieces of fabric and or plastic strips may be utilized.

The illustrated manufacturing operations and apparatus are for use with fabric strips 1410 that have lines of hot melt adhesive already applied thereto. Accordingly, the fabric strip and the adhesive are reheated during fabrication so that the fabric strip sections can be joined together. The fabric folds or seams are commonly made by pulling the fabric through a fixture, which causes the fold to be formed. Alternatively, a procedure, wherein the fabric strip is held against hinged platens via a vacuum and the platens are then folded together, may be used to crease the strip proximate the hinge. Accordingly, hem 1494 of FIG. 17 may be made by any suitable method and apparatus. As discussed above, the hem 1494 may form part of a lever arm such as the one illustrated in FIG. 10 for the ninth embodiment.

In certain embodiments there may also be an adhesive line 1495 on the outside of the hem as shown in FIG. 18. To form a vane cell, fabric of this configuration is laid on a hinged vacuum platen 1496. The platen is then closed, as shown in FIG. 19, and the adhesive line 1495 is heated in any suitable manner to soften it. The adhesive is then permitted to cool, the platen is opened, and the completed cell is removed. The cell can then be bonded to other cells to form the roll up covering. It is to be appreciated that the manufacturing method described herein is merely an example and that many other manufacturing methods that would be obvious to one of ordinary skill in the art may be utilized to fabricate the cells and the roll-up covering.

Although the present invention has been described with a certain degree of particularity, it is understood the disclosure has been made by way of example, and changes in detail or structure may be made without departing from the spirit of the invention as defined in the appended claims.

What is claimed is:

1. A covering for a window, the covering comprising a roller, and a plurality of longitudinally-extending interconnected fabric cells, the cells being vertically spaced from each other and separated by an intervening vertically-extending spacing section, each of said cells and said spacing sections being formed from a strip of material having a first end with the strip extending straight upwardly from the first end to a first fold thereby defining a back wall of the cell between said first end and said first fold, said strip turning downwardly at said first fold to a second fold so as to define a front wall of the cell between said first and second folds, said strip extending rearwardly from said second fold toward and attached to said back wall to define a bottom wall with said front wall being spaced a greater distance from said back wall at said bottom wall than at said first fold, said spacing sections each comprising an extension of said bottom wall, and wherein the cells are adapted to collapse when wound onto the roller and expand when the covering is unwound from the roller.

2. The covering of claim 1 wherein said back wall of each cell is substantially coplanar with said spacing sections.

3. The covering of claim 1 wherein said first fold is a sharp fold.

4. The covering of claim 1 wherein said back walls of the plurality of cells and the spacing sections are comprised of a single sheet of fabric.

5. The covering of claim 1 wherein said bottom wall is concave upwardly.

6. The covering of claim 1 wherein said bottom wall is secured to said first end of said strip of material.

7. The covering of claim 6 wherein said bottom wall extends upwardly at its connection to said first end.

8. The covering of claim 7 wherein said strip of material is folded to extend downwardly toward a second end of said fabric strip above the connection of the bottom wall to said first end.

9. The covering of claim 8 wherein said strip of material between said downward fold and said second end defines a spacing section.

* * * * *